US011060663B2

(12) United States Patent
Maekawa

(10) Patent No.: US 11,060,663 B2
(45) Date of Patent: Jul. 13, 2021

(54) PRESSURE VESSEL AND METHOD OF MANUFACTURING PRESSURE VESSEL

(71) Applicant: TOYOTA JIDOSHA KABUSHIKI KAISHA, Toyota (JP)

(72) Inventor: Motoki Maekawa, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 491 days.

(21) Appl. No.: 15/822,765

(22) Filed: Nov. 27, 2017

(65) Prior Publication Data

US 2018/0156387 A1 Jun. 7, 2018

(30) Foreign Application Priority Data

Dec. 6, 2016 (JP) ..... JP2016-236567

(51) Int. Cl.
*F17C 1/02* (2006.01)
*F17C 13/04* (2006.01)

(52) U.S. Cl.
CPC ..... *F17C 1/02* (2013.01); *F17C 13/04* (2013.01); *F17C 2201/0104* (2013.01); *F17C 2201/0109* (2013.01); *F17C 2203/011* (2013.01); *F17C 2203/0604* (2013.01); *F17C 2203/066* (2013.01); *F17C 2203/0663* (2013.01); *F17C 2205/0115* (2013.01); *F17C 2205/0317* (2013.01); *F17C 2205/0323* (2013.01); *F17C 2209/2154* (2013.01); *F17C 2209/22* (2013.01); *F17C 2221/012* (2013.01); *F17C 2223/0123* (2013.01); *F17C 2223/036* (2013.01); *F17C 2260/033* (2013.01); *F17C 2270/0184* (2013.01)

(58) Field of Classification Search
CPC .... F17C 1/02; F17C 13/04; F17C 2201/0109; F17C 2201/0104; F17C 2203/011; F17C 2203/0604; F17C 2203/066; F17C 2203/0663
USPC ..... 220/592, 648, 649
See application file for complete search history.

(56) References Cited

U.S. PATENT DOCUMENTS

2009/0078706 A1* 3/2009 Ishitoya ..... F17C 13/04 220/562
2009/0255940 A1* 10/2009 Murate ..... F17C 1/16 220/592

(Continued)

FOREIGN PATENT DOCUMENTS

DE 696 22 022 T2 1/2003
JP 2009-108971 5/2009

(Continued)

*Primary Examiner* — J. Gregory Pickett
*Assistant Examiner* — Niki M Eloshway
(74) *Attorney, Agent, or Firm* — Finnegan, Henderson, Farabow, Garrett & Dunner, LLP

(57) ABSTRACT

A pressure vessel includes a vessel main body, a first protective member, and a second protective member. The vessel main body is configured to contain gas inside. The second protective member is configured to exhibit performance that is different from that of the first protective member. One of the first protective member and the second protective member has recesses that the other one of the first protective member and the second protective member does not have at an end on a peak of a domical panel side provided with the one of the first protective member and the second protective member.

7 Claims, 8 Drawing Sheets

(56) References Cited

U.S. PATENT DOCUMENTS

| | | | | |
|---|---|---|---|---|
| 2011/0056960 | A1* | 3/2011 | Blanc | B29C 70/086 220/588 |
| 2011/0210516 | A1* | 9/2011 | Sharp | F17C 1/16 277/312 |
| 2013/0105501 | A1* | 5/2013 | Vanswijgenhoven | B29C 53/602 220/660 |
| 2014/0014668 | A1* | 1/2014 | Silva Vieira | F17C 1/06 220/590 |
| 2015/0001229 | A1* | 1/2015 | Helmig | B29C 49/20 220/592 |
| 2015/0204483 | A1 | 7/2015 | Kojima et al. | |
| 2017/0254477 | A1* | 9/2017 | Schimenti | F17C 1/06 |
| 2018/0104916 | A1* | 4/2018 | Nishiwaki | F17C 1/16 |
| 2018/0259129 | A1* | 9/2018 | Christ | F17C 13/06 |
| 2019/0203883 | A1* | 7/2019 | Kojima | F17C 1/16 |

FOREIGN PATENT DOCUMENTS

| | | | |
|---|---|---|---|
| JP | 2014-74470 | | 4/2014 |
| JP | 2014-185714 | | 10/2014 |
| JP | 2014-186893 | A | 10/2014 |
| JP | 2014-190495 | A | 10/2014 |
| JP | 2014190495 | A * | 10/2014 |
| JP | 2016-156451 | | 9/2016 |
| WO | WO 96/23721 | A1 | 8/1996 |
| WO | WO 2008/042321 | A1 | 4/2008 |

* cited by examiner

PRESSURE VESSEL AND METHOD OF MANUFACTURING PRESSURE VESSEL

INCORPORATION BY REFERENCE

The disclosure of Japanese Patent Application No. 2016-236567 filed on Dec. 6, 2016 including the specification, drawings and abstract is incorporated herein by reference in its entirety.

BACKGROUND

1. Technical Field

The present disclosure relates to a pressure vessel containing high-pressure gas and a method of manufacturing a pressure vessel.

2. Description of Related Art

In the related art, there are pressure vessels having a shape in which domical panels that protrude outwards are disposed at both ends of a cylindrical shell plate. In the central position of each of the panels which is a position that coincides with the central axis of the shell plate, a cap is provided. The pressure vessels are manufactured as described below. First, a shape of the inside of the pressure vessel is determined using a liner that is a resin. After the disposition of the cap in each of the panels, carbon fiber reinforced plastics (CFRP) is wound around the outside of the liner, thereby forming a reinforcement layer. CFRP is wound around the liner using a filament winding method. Since CFRP is wounded using the filament winding method, in the panel, a thin-walled portion in which the reinforcement layer has a thinner thickness than any other portions is formed between the central portion in which the cap is provided and the end portion near the shell plate.

In the technique of Japanese Unexamined Patent Application Publication No. 2014-074470 (JP 2014-074470 A), a protective member is disposed so as to cover each of the thin-walled portions in the panels at both ends in order to prevent an incidence in which the pressure vessel breaks in the thin-walled portions. The protective member is disposed so as to surround the cap between the central portion in which the cap is provided and the end portion near the shell plate.

In one panel of the pressure vessel, a communication hole for injecting gas into the pressure vessel and discharging the gas from the pressure vessel and a valve that opens and closes the communication hole are provided. In the technology of JP 2014-074470 A, a protective member configured of a single layer of foamable polyurethane is disposed in the panel that is provided with the valve. The protective member has a function of relaxing external impact.

In the technology of JP 2014-074470 A, a protective member having a double-layered structure in which a portion configured of foamable polyurethane is covered with foamable polyurethane including expandable graphite is disposed in the other panel. A function of relaxing external impact is imparted by the portion configured of foamable polyurethane. A heat-shielding effect is exhibited by the portion configured of the foamable polyurethane including expandable graphite. More specifically, when the protective member is exposed to high temperatures, the foamable polyurethane including expandable graphite forms foam and rapidly expands. As a result, the heat-shielding effect is exhibited.

SUMMARY

A fusible plug valve is disposed near the valve in the pressure vessel. When exposed to high temperatures, the fusible plug valve partially fuses, opens the valve, and communicates the inside and outside of the pressure vessel. As a result, high-pressure gas in the pressure vessel is discharged to the outside. The protective member disposed in the panel with the valve (with the fusible plug valve) is preferably not provided with a function that exhibits the heat-shielding effect so as to prevent the function of the fusible plug valve from being hindered.

However, in the technology of JP 2014-074470 A, the panels positioned at both ends of the shell plate have the same shape (in the specification, "the same shape" also means "substantially the same shape"). Therefore, the protective member having the heat-shielding function and the protective member not having the heat-shielding function which are respectively attached to the panels may be attached to any panels. Therefore, there is a possibility that the protective member having the heat-shielding function is attached to the panel with the valve (with the fusible plug valve) or the protective member not having the heat-shielding function is attached to the panel with no valve.

Aspects of the present disclosure can be realized as the following forms or application examples.

A first aspect of the present disclosure relates to a pressure vessel. The pressure vessel includes a vessel main body, a first protective member, and a second protective member. The vessel main body includes a cylindrical shell plate, a first domical panel, and a second domical panel. The first domical panel is disposed at first end of the cylindrical shell plate. The second domical panel is disposed at second end of the cylindrical shell plate. The first protective member is disposed so as to surround a peak of the first domical panel. The second protective member is disposed so as to surround a peak of the second domical panel. The vessel main body is configured to contain gas inside. The second protective member is configured to exhibit performance that is different from that of the first protective member. One of the first protective member and the second protective member has recesses that the other one of the first protective member and the second protective member does not have at an end on one of the peak side of the first domical panel and the peak side of the second domical panel disposed with the one of the first protective member and the second protective member. The first aspect of the present disclosure enables a clear differentiation between the first protective member and the second protective member based on the recesses. Therefore, in the manufacturing of the pressure vessel, it is possible to attach the first protective member and the second protective member to appropriate panels, respectively. In addition, the recesses are provided at the end on the peak side of the domical panel, and thus it is possible to differentiate the first protective member and the second protective member without substantially degrading the functions of the protective members.

In the pressure vessel according to the first aspect, the vessel main body may further include a fusible plug valve in the first domical panel. The first protective member may be disposed so as to surround the peak of the first domical panel and the fusible plug valve. The second protective member may have better heat-shielding performance than the first protective member. With the first aspect of the present disclosure, it is possible to decrease the possibility of the second protective member having better heat-shielding performance than the first protective member being attached to the panel including the fusible plug valve during the manufacturing of the pressure vessel.

In the pressure vessel according to the first aspect, the first protective member and the second protective member may have one or more recesses at the end on the peak side of the domical panel. The recesses provided in the first protective member and the recesses provided in the second protective member may have different shapes from each other. The first aspect of the present disclosure enables a clear differentiation between the first protective member and the second protective member based on the shapes of the respective recesses. Therefore, in the manufacturing of the pressure vessel, it is possible to attach the first protective member and the second protective member to appropriate panels, respectively. In addition, it is possible to provide the recesses with shapes suitable for the securement of performance such as heat-shielding performance that the respective protective members are supposed to have.

A second aspect of the present disclosure relates to a method of manufacturing a pressure vessel, the pressure vessel being configured to contain gas. The method of manufacturing a pressure vessel includes (a) preparing a vessel main body including a cylindrical shell plate, a first domical panel, and a second domical panel, the first domical panel being disposed at first end of the cylindrical shell plate, the second domical panel being disposed at second end of the cylindrical shell plate; (b) disposing a circular first protective member held in a first jig to the first domical panel on an opposite side of the first domical panel from the cylindrical shell plate; (c) disposing a circular second protective member held in a second jig to the second domical panel on an opposite side of the second domical panel from the cylindrical shell plate, the circular second protective member being a member exhibiting performance different from that of the circular first protective member; and (d) attaching the circular first protective member and the circular second protective member so as to surround a peak of the first domical panel and a peal of the second domical panel by pressing the circular first protective member and the circular second protective member to the first domical panel and the second domical panel using the first jig and the second jig while rotating at least one of the circular first protective member and the circular second protective member using the first jig or the second jig. One of the circular first protective member and the circular second protective member has recesses that the other one of the circular first protective member and the circular second protective member does not have at an end positioned on a central axis side of the one of the circular first protective member and the circular second protective member. The second aspect of the present disclosure enables a clear differentiation between the first protective member and the second protective member based on the recesses. Therefore, it is possible to respectively attach the first protective member and the second protective member to appropriate jigs. In addition, the recesses are provided at the end positioned on the central axis side of the circular protective member, and thus it is possible to differentiate the first protective member and the second protective member without substantially degrading the functions of the protective members.

In the manufacturing method according to the second aspect, the circular first protective member may be disposed to the first domical panel in which the fusible plug valve is disposed. The circular first protective member may be attached such that the circular first protective member surrounds the peak of the first domical panel and the fusible plug valve. The circular second protective member may be a protective member having better heat-shielding performance than the first protective member. With the second aspect of the present disclosure, it is possible to decrease the possibility of the second protective member having better heat-shielding performance than the first protective member being attached to the panel including the fusible plug valve.

In the manufacturing method according to the second aspect, each of the circular first protective member and the circular second protective member may have one or more recesses at the end positioned on the central axis side of a corresponding one of the circular first protective member and the circular second protective member. The recesses provided in the first protective member and the recesses provided in the second protective member may have different shapes from each other. The second aspect of the present disclosure enables a clear differentiation between the first protective member and the second protective member based on the shapes of the respective recesses. Therefore, it is possible to prevent incorrect attachment to the panels at both ends of the vessel main body.

In the manufacturing method according to the second aspect, the recess may have a shape in which the recess reaches a surface of the circular first protective member or the circular second protective member in contact with the first domical panel or the second domical panel after the circular first protective member or the circular second protective member provided with the recess is pressed and attached to the first domical panel or the second domical panel. In the second aspect of the present disclosure, the recesses opened toward the central axis of rotation are provided so as to reach the surface of the first protective member or the second protective member in contact with the panel. Therefore, the contact surface of the protective member with the panel has a contour shape having a component that is perpendicular to a circumferential direction of rotation in the recesses. Therefore, when the protective member is rotated and pressed to the panel, sliding in the circumferential direction does not easily occur between the protective member and the panel.

In the manufacturing method according to the second aspect, in a state in which the one of the circular first protective member and the circular second protective member is held in a corresponding one of the first jig and the second jig, protrusions provided in the first jig or the second jig may be inserted into recesses that the other one of the circular first protective member and the circular second protective member does not have. With the second aspect of the present disclosure, even when an attempt is made to hold the other protective member in the jig which is supposed to hold the one protective member including the recesses that the other protective member does not have, it is not possible to appropriately hold the other protective member in the jig due to the protrusions provided in the jig. Therefore, it is possible to prevent incorrect attachment to the panels at both ends of the vessel main body. In addition, the protrusions provided in the jig are received by the recesses provided in the protective member, and thus it is possible to decrease the possibility of the occurrence of sliding between the jig and the protective member when the protective member is attached to the panel by rotating and pressing the protective member to the panel.

The present disclosure can also be realized in a variety of forms other than the pressure vessel and the method of manufacturing a pressure vessel. For example, the present disclosure can be realized in forms of apparatuses for manufacturing a pressure vessel, devices into which the pressure vessel of the form is combined, methods and apparatuses for manufacturing the devices, methods for designing the apparatuses, and the like.

Not all of the plurality of constituent elements that the respective forms of the present disclosure have are indispensable. In order to achieve a part or all of the effects described in the specification, some of the constituent elements can be appropriately modified, deleted, or exchanged with new constituent elements, and part of limitation contents can be deleted. In addition, in order to achieve a part or all of the effects described in the specification, a part or all of the technical features of one form of the present disclosure can be combined with a part or all of the technical features of another form of the present disclosure, thereby creating an independent form of the present disclosure.

BRIEF DESCRIPTION OF THE DRAWINGS

Features, advantages, and technical and industrial significance of exemplary embodiments of the present disclosure will be described below with reference to the accompanying drawings, in which like numerals denote like elements, and wherein.

DETAILED DESCRIPTION OF EMBODIMENTS

Embodiments—Configuration of High-Pressure Tank

Figure 1:
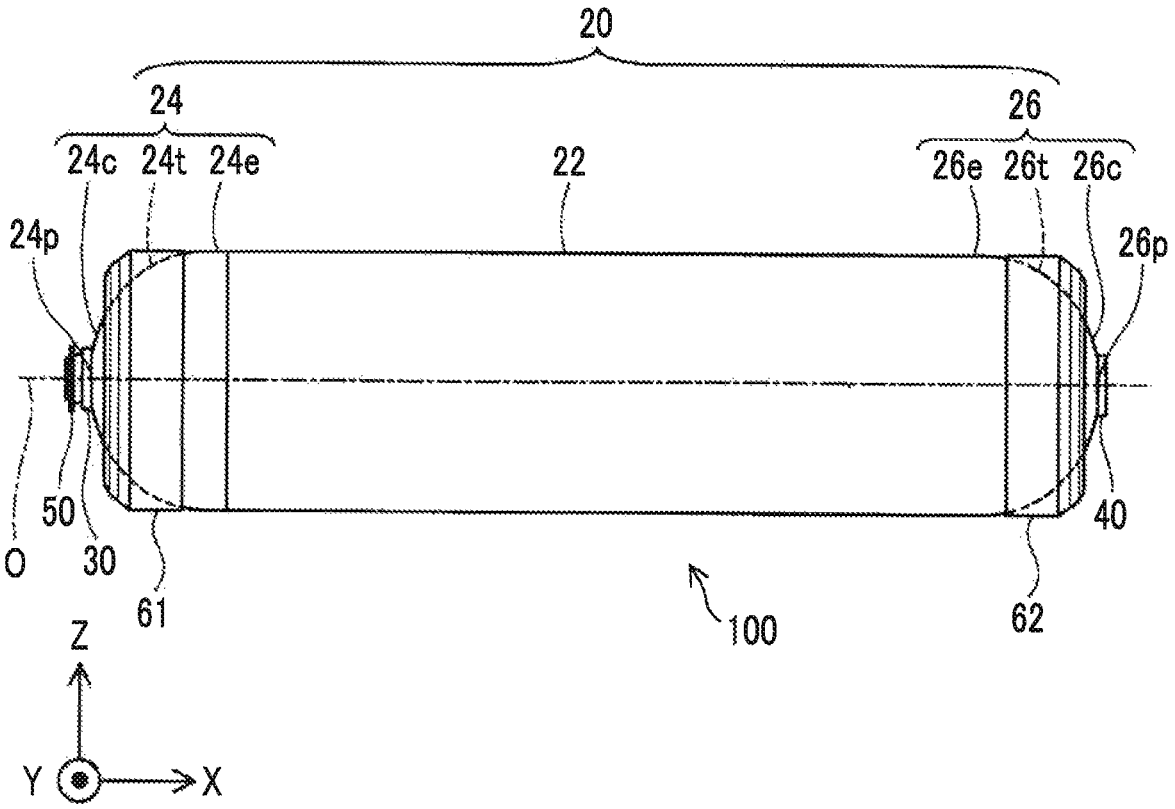
FIG. 1 is a side view of a high-pressure tank of an embodiment.

FIG. 1 is a side view of a high-pressure tank 100 of an embodiment. The X-axis, the Y-axis, and the Z-axis illustrated in FIG. 1 are perpendicular to one another. X-axes, Y-axes, and Z-axes corresponding to the X-axis, the Y-axis, and the Z-axis illustrated in FIG. 1 are also illustrated in other views, respectively.

The high-pressure tank 100 is mounted in fuel cell vehicles, contains hydrogen gas, and supplies the hydrogen gas to fuel cells. The high-pressure tank 100 includes a vessel main body 20, a valve-side cap 30, an end-side cap 40, a valve 50, a first protective member 61, and a second protective member 62.

The vessel main body 20 is capable of containing hydrogen gas inside. The vessel main body 20 has a shell plate 22 and panels 24, 26 disposed at both ends of the shell plate 22. The shell plate 22 has a cylindrical shape. The orientation of a central axis O of a cylinder of the shell plate 22 coincides with the X-axis. The panels 24, 26 are domical panels and are disposed in openings at both ends of the substantially cylindrical-form shell plate 22 so as to protrude outwards. In the panels 24, 26, peaks 24*p*, 26*p* that are portions that respectively protrude outwards the most in the X-axis direction are present at positions at which the central axis O and the panels 24, 26 intersect each other.

The vessel main body 20 has a substantially double-layered structure. An inner layer of the vessel main body 20 is configured of a resin liner. The liner specifies the inner shape of the vessel main body 20. An outer layer of the vessel main body 20 is a reinforcement layer configured of carbon fiber reinforced plastics (CFRP).

Since CFRP is configured using a filament winding method (hereinafter, also referred to as "FW method"), the reinforcement layer has thin-walled portions 24*t*, 26*t* having a thinner thickness than any other portions. The thin-walled portion 24*t* is positioned between a central portion 24*c* including the peak 24*p* provided with the valve-side cap 30 and an end portion 24*e* near the shell plate 22 in the panel 24. The thin-walled portion 26*t* is positioned between a central portion 26*c* including the peak 26*p* provided with the end-side cap 40 and an end portion 26*e* near the shell plate 22 in the panel 26.

The valve-side cap 30 is provided at the peak 24*p* of the dome of the panel 24. The valve-side cap 30 is provided with the valve 50 that opens and closes a communication hole for injecting hydrogen gas into the high-pressure tank 100 and discharging hydrogen gas from the high-pressure tank 100. The valve 50 is further provided with a fusible plug valve. When exposed to high temperatures, the fusible plug valve partially fuses, opens the valve, and communicates the inside and outside of the pressure vessel. As a result, high-pressure gas in the pressure vessel is discharged to the outside. The fusible plug valve is opened irrespective of the opening and closing of the communication hole in the valve 50.

The end-side cap 40 is provided at the peak 26*p* of the dome of the panel 26. The end-side cap 40 is configured of metal having a relatively high thermal conductivity and is exposed to both the inside and outside of the high-pressure tank 100 (vessel main body 20). The end-side cap 40 has a function of discharging heat in the high-pressure tank 100 to the outside. The panel 26 is not provided with any fusible plug valves.

The first protective member 61 is provided on the panel 24 so as to cover the thin-walled portion 24*t* of the panel 24. As a result, the first protective member 61 is disposed so as to cover the peak 24*p* of the dome of the panel 24 and the valve-side cap 30 including the fusible plug valve. The first protective member 61 has a function of relaxing impact that is applied to the thin-walled portion 24*t* from the outside.

The second protective member 62 is provided on the panel 26 so as to cover the thin-walled portion 26*t* of the panel 26. As a result, the second protective member 62 is disposed so as to cover the peak 26*p* of the dome of the panel 26 and the end-side cap 40. The second protective member 62 has a function of relaxing impact that is applied to the vessel main body 20 from the outside and a function of shielding heat that is applied to the thin-walled portion 26*t* from the outside.

Figure 2:
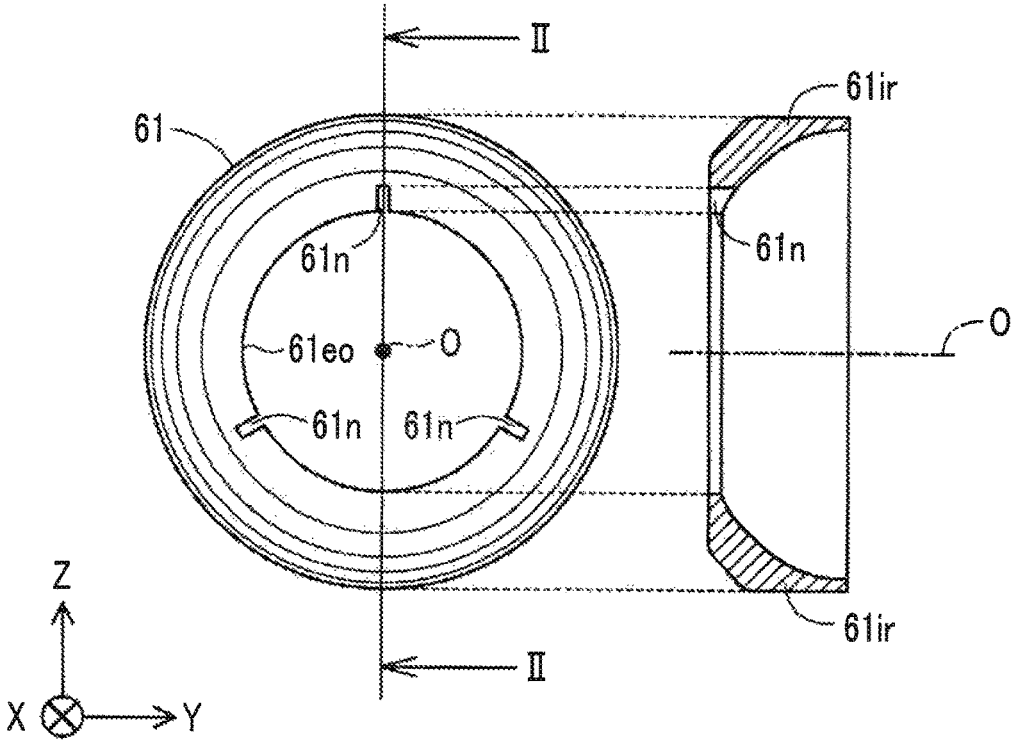
FIG. 2 is an explanatory view illustrating a first protective member.

FIG. 2 is an explanatory view illustrating the first protective member 61. FIG. 2 includes a plan view of the first protective member 61 and a cross-sectional view of a II-II cross-section illustrated in the plan view. The first protective member 61 has a tubular shape in which the dimension in the central axis O direction is smaller than the radius, in other words, a circular shape. The outer diameter of an end portion of the first protective member 61 on the negative side of the X-axis is smaller than the outer diameter of an end portion on the positive side of the X-axis. The outer diameter of a portion in the X-axis direction including the end portion on the positive side of the X-axis is constant. The inner diameter of an opening at the end portion of the first protective member 61 on the negative side of the X-axis is smaller than the inner diameter of an opening at the end portion on the positive side of the X-axis. The inner surface (the surface facing the central axis O) of the first protective member 61 has a shape that substantially coincides with the outer form of the thin-walled portion 24*t* of the panel 24 and is a curved surface having a cross-sectional shape protruding outwards.

The inner surface of the opening at the end portion of the first protective member 61 on the negative side of the X-axis is provided with three recesses 61*n* at equal angular intervals of 120° around the central axis O. In the first protective member 61, the respective recesses 61*n* are positioned at an end 61*eo* on a peak 24*p* side (on the central axis O side) of the panel 24 to which the first protective member 61 is attached (refer to FIG. 2). The shape of the recess 61*n* is a substantially rectangular shape that extends outwards in the radial direction of the circle. The recesses 61*n* are provided from the outer surface (the end surface on the negative side in the X-axis direction) through the inner surface (the surface that comes into contact with the panel 24) of the first protective member 61.

The first protective member 61 is configured of a single layer 61*ir* of foamable polyurethane. The first protective member 61 relaxes impact that is applied to the thin-walled portion 24*t* from the outside due to the elasticity of the foaming structure of the foamable polyurethane.

Figure 3:
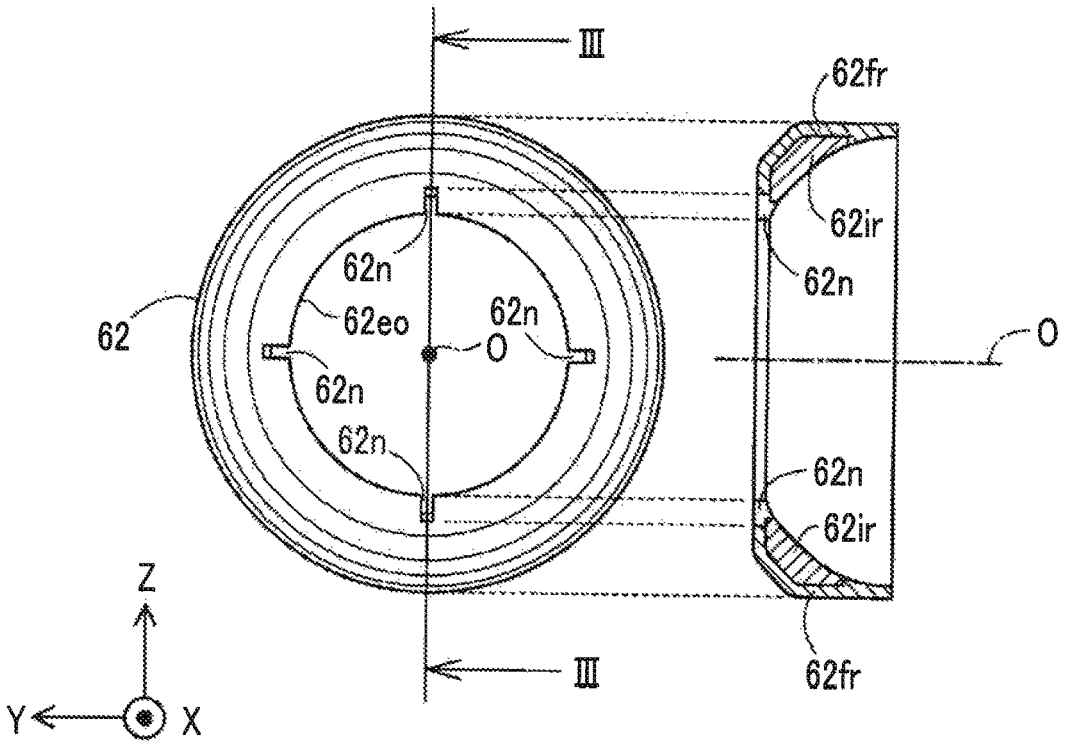
FIG. 3 is an explanatory view illustrating a second protective member.

FIG. 3 is an explanatory view illustrating the second protective member 62. FIG. 3 includes a plan view illustrating the second protective member 62 and a cross-sectional view of a III-III cross-section illustrated in the plan view. In the second protective member 62, the number, disposition, and shape of recesses 62*n* provided on the inner surface of an opening at an end portion on the positive side of the X-axis are different from those in the first protective member 61. The outer form shape of the second protective member 62 is the same as the outer form shape of the first protective member 61 in other aspects. In addition, the second protective member 62 is different from the first protective member 61 in internal structure.

The second protective member 62 includes a first layer 62*ir* that is exposed on the inner surface of the tubular structure and a second layer 62*fr* that almost covers the first layer 62*ir* and is exposed on the outer surface of the tubular structure. The material of the first layer 62*ir* is foamable polyurethane that is the same as the material configuring the single layer 61*ir* of the first protective member 61. The material of the second layer 62*fr* is foamable polyurethane including expandable graphite. The second protective member 62 relaxes impact that is applied to the thin-walled portion 26*t* from the outside due to the elasticity of the foaming structure of the foamable polyurethane in the first layer 62*ir* and the second layer 62*fr*. In addition, when the second protective member 62 is exposed to high temperatures, the second layer 62*fr* including expandable graphite forms foam and rapidly expands. As a result, an action of shielding heat that is applied to the thin-walled portion 26*t* from the outside is exhibited.

The inner surface of the opening at the end portion of the second protective member 62 on the positive side of the X-axis is provided with four recesses 62*n* at equal angular intervals of 90° around the central axis O. In the second protective member 62, the respective recesses 62*n* are positioned at an end 62*eo* on a peak 26*p* side (on the central axis O side) of the panel 26 to which the second protective member 62 is attached (refer to FIG. 3). In the portion provided with the recesses 62*n*, out of the first layer 62*ir* that is the internal layer, the inner surface portion of the opening and some of the end portion on the positive side of the X-axis are not covered with the second layer 62*fr* (refer to the cross-sectional view of FIG. 3). With respect to other portions, the portions in which the second layer 62*fr* is not present configure the recesses 62*n* in the second protective member 62. Therefore, the shape of the recess 62*n* in the second protective member 62 is different from the shape of the recess 61*n* in the first protective member 61 having a constant shape in the X-axis direction (refer to the cross-sectional view of FIG. 2). The recesses 62*n* are also provided from the outer surface (the end surface on the positive side in the X-axis direction) through the inner surface (the surface that comes into contact with the panel 26) of the second protective member 62.

The configuration enables the determination of the shape of the recess 62*n* in the second protective member 62 so as to appropriately have impact-resisting performance and heat-shielding performance attributed to the first layer 62*ir* and the second layer 62*fr*. Similarly, for the recesses 61*n* in the first protective member 61 as well, the configuration enables the determination of the shape of the recess 61*n* so as to appropriately exhibit impact-resisting performance attributed to the first protective member 61.

The second protective member 62 includes a fourth recess 62*n* that the first protective member 61 does not have (refer to FIG. 2 and FIG. 3). In addition, the second protective member 62 includes the recesses 62*n* respectively with respect to one recess 62*n* at angular positions of 900, 180°, and 270° around the central axis O. In contrast, the first protective member 61 does not have recesses that are present at the relative positions with respect to one recess 61*n*. That is, the second protective member 62 can be said to have recesses that the first protective member 61 does not have in terms of the difference in the number and disposition as well as the difference in shape.

Meanwhile, the first protective member 61 includes the recesses 61*n* respectively with respect to one recess 61*n* at angular positions of 120° and 240° around the central axis O. In contrast, the second protective member 62 does not have recesses that are present at the relative positions with respect to one recess 62*n*. That is, the first protective member 61 can be said to have recesses that the second protective member 62 does not have in terms of the difference in disposition as well as the difference in shape.

For the functional request of protecting the thin-walled portions 24*t*, 26*t* of the panels 24, 26 having substantially the same outer form shape, the first protective member 61 and the second protective member 62 have substantially the same outer form shape. However, in the embodiment, the recesses provided in the first protective member 61 and the second protective member 62 are different from each other in the number, disposition, and shape. Therefore, the first protective member 61 and the second protective member 62 can be clearly differentiated from each other based on the recesses. Therefore, it is possible to decrease the possibility of the erroneous attachment of the first protective member 61 and the second protective member 62 to the vessel main body 20 during the manufacturing of the high-pressure tank 100.

As means for differentiating the first protective member 61 and the second protective member 62, an aspect of forming protrusions in the protective members can be considered. However, in the embodiment, as means for differentiating the first protective member 61 and the second protective member 62, the recesses are employed. Therefore, in the attachment of the high-pressure tank 100 to predetermined devices, interference between the high-pressure tank 100 and other components does not occur, and spaces needed for disposition does not expand.

In the first protective member 61 and the second protective member 62, the recesses are provided at the ends on the peaks 24*p*, 26*p* side (on the central axis O side of the circular first protective member or second protective member) of the panels 24, 26 to which the first protective member 61 and the second protective member 62 are attached. The impact on the high-pressure tank 100 is highly likely to be applied from the side surface of the high-pressure tank 100 and is highly unlikely to be applied from the peaks 24*p*, 26*p* of the panels 24, 26 in the central axis O direction. Therefore, when the recesses are provided as described in the embodiment, it becomes possible to differentiate the first protective member 61 and the second protective member 62 without substantially degrading the function of the first protective member 61 and the second protective member 62 that relax impact. Meanwhile, the shape of the recesses does not significantly degrade the heat-shielding function of the second protective member 62.

The high-pressure tank 100 in the embodiment corresponds to the "pressure vessel" in "SUMMARY".

Figure 4:
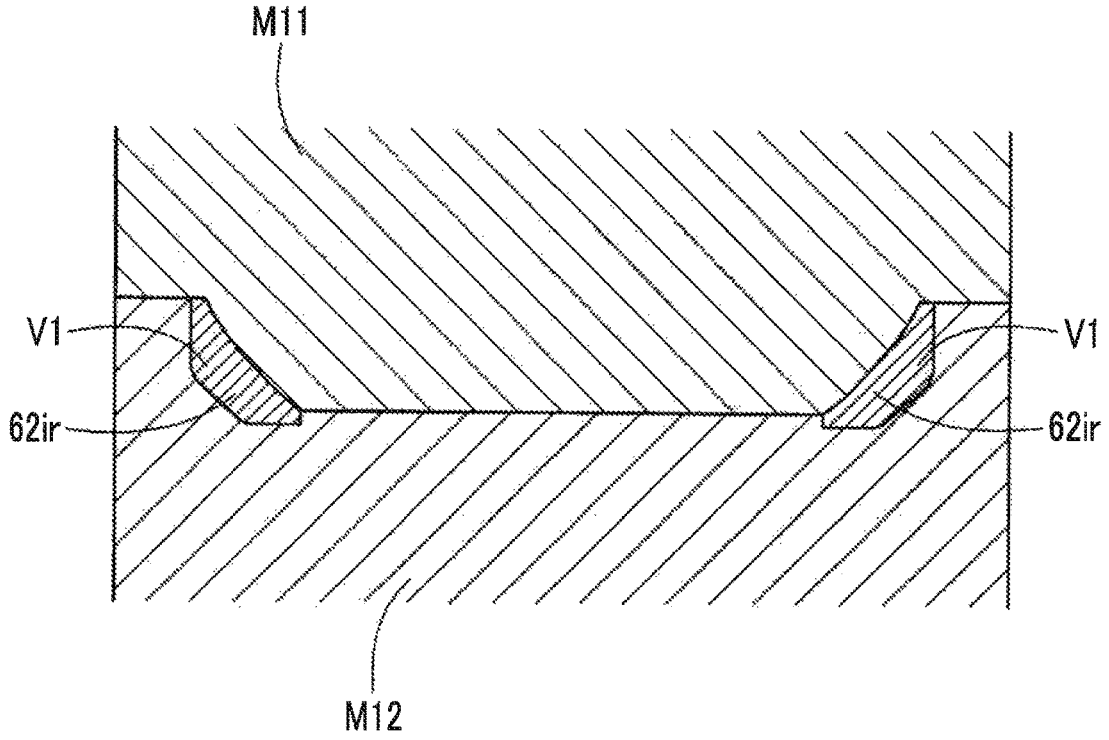
FIG. 4 is a cross-sectional view illustrating a treatment for generating a first layer of the second protective member.
Figure 5:
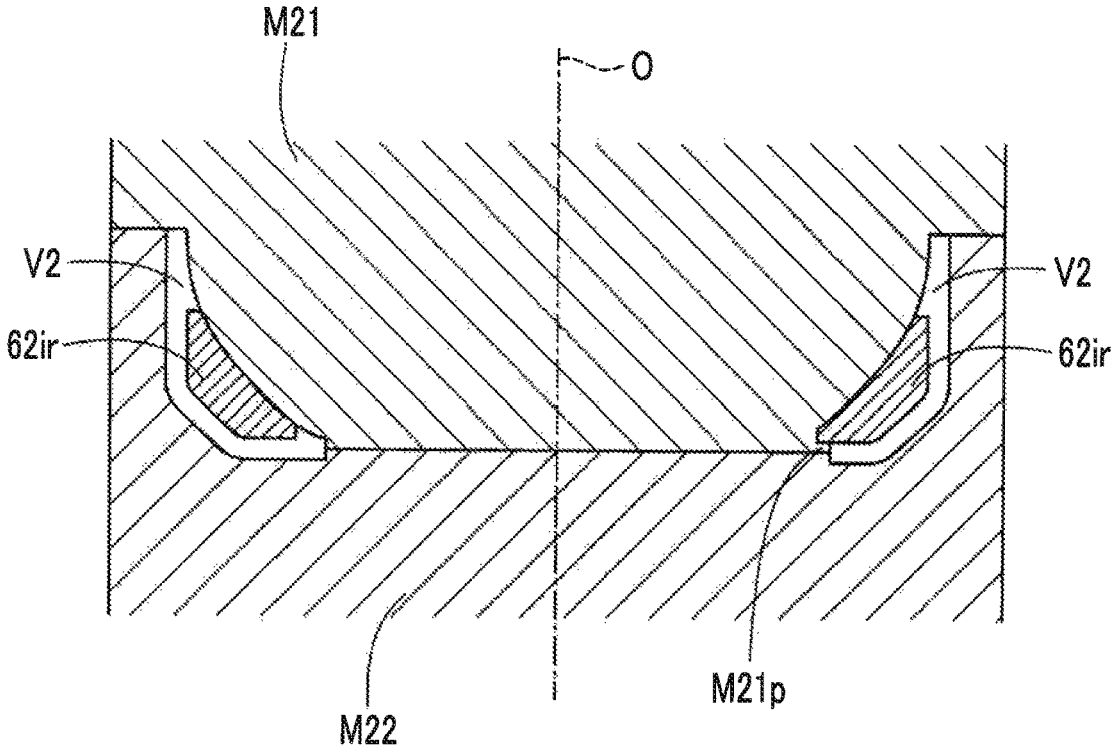
FIG. 5 is a cross-sectional view illustrating a treatment for generating a second layer of the second protective member.
Figure 6:
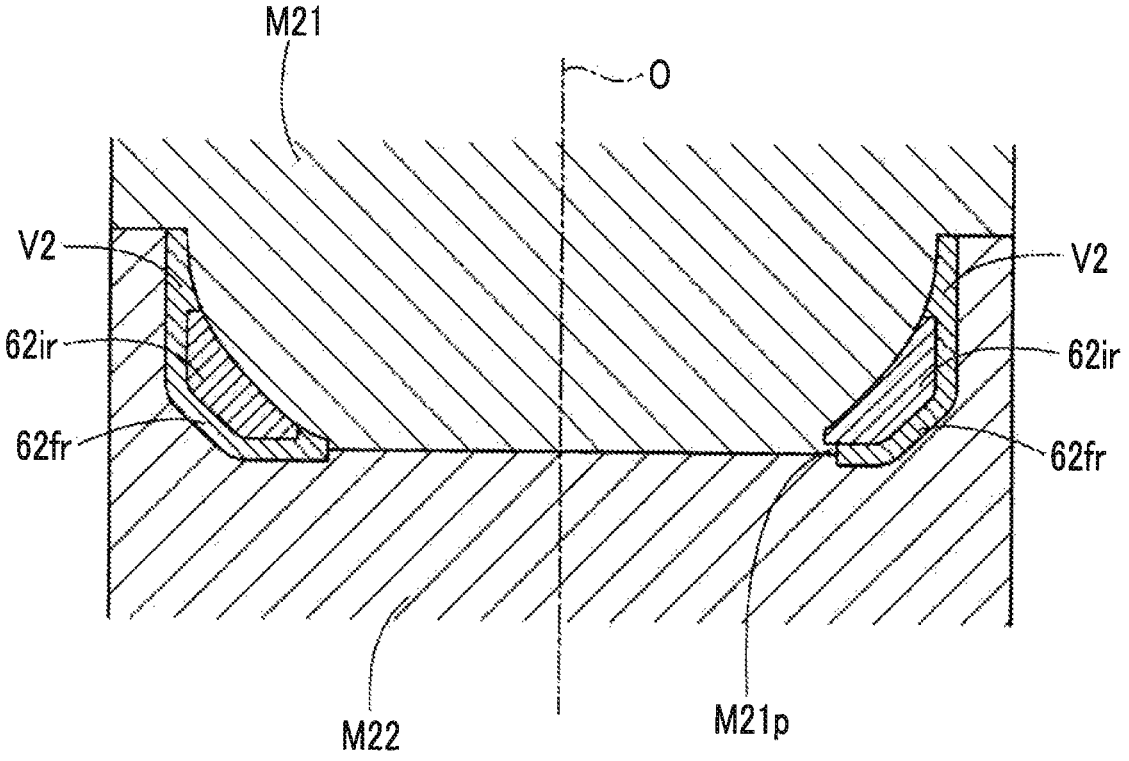
FIG. 6 is a cross-sectional view illustrating a treatment for generating the second layer of the second protective member.

Method of Manufacturing High-Pressure Tank:

FIGS. 4 to 6 are cross-sectional views illustrating treatments for generating the second protective member 62 (refer to FIG. 3). FIG. 4 is a cross-sectional view illustrating a treatment for generating the first layer 62*ir* (refer to the cross-sectional view of FIG. 3) of the second protective member 62. A substantially circular void V1 is provided between a first upper mold M11 and a first lower mold M12. The first layer 62*ir* of the second protective member 62 is generated by injecting and solidifying foamable polyurethane in the void V1.

FIG. 5 is a cross-sectional view illustrating a treatment for generating the second layer 62*fr* (refer to the cross-sectional view of FIG. 3) of the second protective member 62. The right half of FIG. 5 illustrates a cross-section of molds in a portion in which the recess 62*n* (refer to the cross-sectional view of FIG. 3) of the second protective member 62 is formed. The left half of FIG. 5 illustrates a cross-section of the molds in a portion in which the recess 62*n* of the second protective member 62 is not formed. This shall also apply to FIG. 6 described below.

A substantially circular void V2 is provided between a second upper mold M21 and a second lower mold M22. At the lower end of the second upper mold M21, four protrusions M21*p* are provided at equal angular intervals of 90° around the central axis O so as to protrude toward to the outside of the circle. The first layer 62*ir* formed by the treatment of FIG. 4 is supported by the four protrusions M21*p* in the void V2 and is held in contact with the second upper mold M21. Below the four protrusions M21*p*, even on the second lower mold M22 side, part of the second lower mold M22 is positioned, and the void V2 is not provided.

FIG. 6 is a cross-sectional view illustrating a treatment for generating the second layer 62*fr* of the second protective member 62. The second layer 62*fr* of the second protective member 62 is generated by injecting and solidifying foamable polyurethane including expandable graphite in the void V2 (refer to FIG. 5) that is partially occupied by the first layer 62*ir*. In the formation of the second layer 62*fr*, the second layer 62*fr* is not generated, out of the first layer 62*ir*, on portions supported by the protrusions M21*p*. The portions are the four recesses 62*n* of the second protective member 62 (refer to FIG. 3). The second protective member 62 is generated by the treatments.

Meanwhile, the first protective member 61 (refer to FIG. 2) is formed by injecting and solidifying foamable polyurethane in a void between an upper mold and a lower mold having configurations similar to those of the second upper mold M21 and the second lower mold M22 illustrated in FIGS. 5 and 6. However, regarding protrusion-shaped configurations that are provided in the upper mold and the lower mold in order to form the recesses 61*n* (refer to FIG. 2), three configurations are provided at equal angular intervals of 120°.

Figure 7:
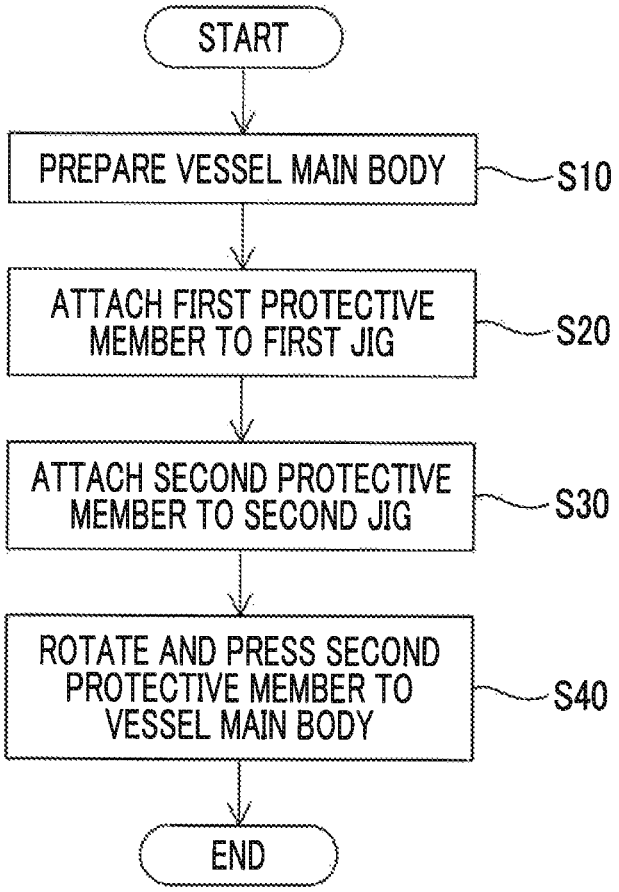
FIG. 7 is a flowchart illustrating treatments for manufacturing the high-pressure tank.

FIG. 7 is a flowchart illustrating treatments for manufacturing the high-pressure tank 100 after the generation of the first protective member 61 and the second protective member 62 (refer to FIGS. 4 to 6). In step S10, separately from the first protective member 61 and the second protective member 62, the vessel main body 20 is prepared. The vessel main body 20 is generated by, approximately, winding CFRP around a resin liner and thermally treating CFRP. After that, the vessel main body 20 is held in an assembly apparatus 400. Meanwhile, in the stage, the valve-side cap 30 and the end-side cap 40 (refer to FIG. 1) are already attached to the vessel main body 20.

Figure 8:
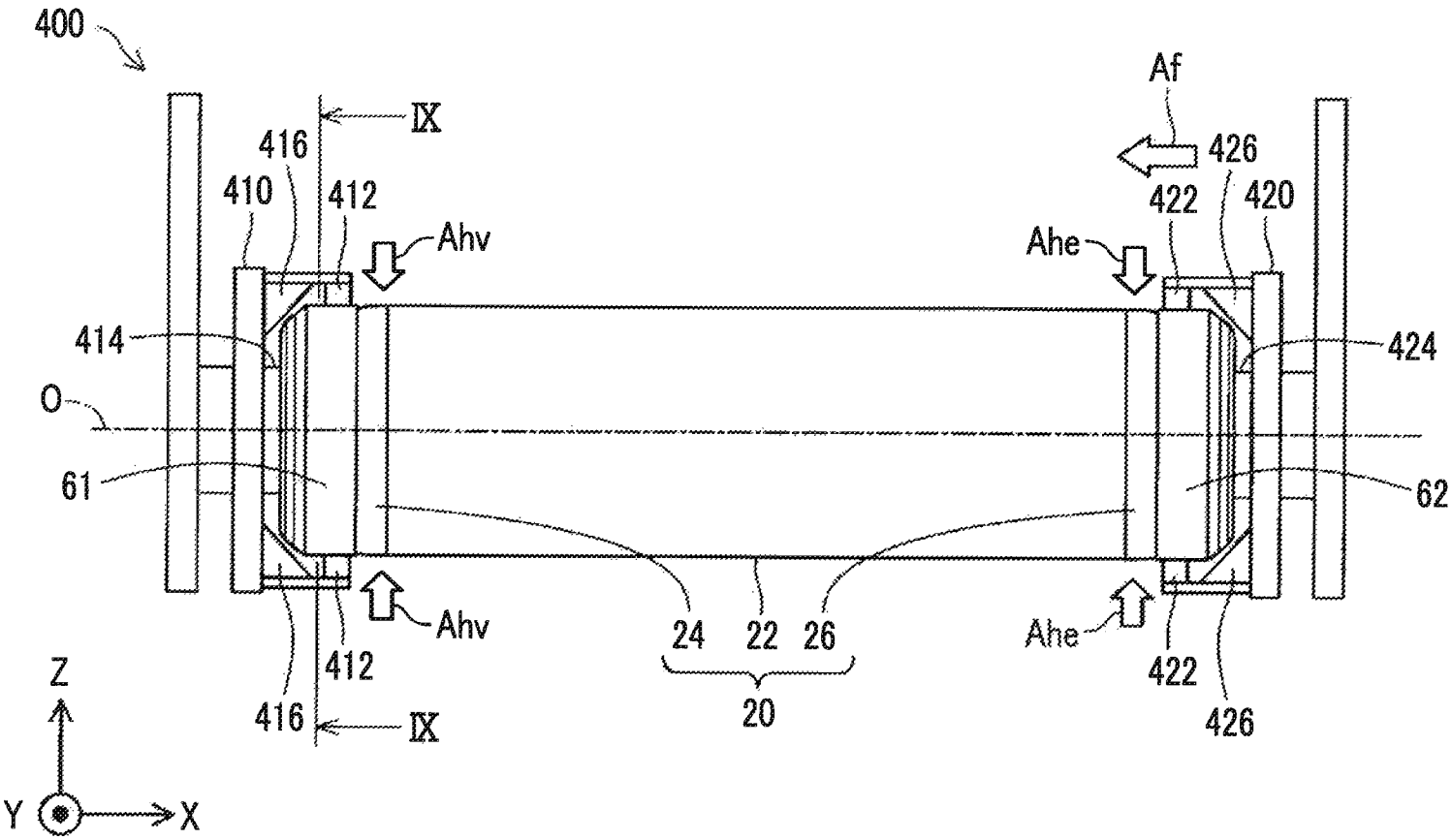
FIG. 8 is an explanatory view illustrating a treatment for attaching the first protective member and the second protective member to a vessel main body.

FIG. 8 is an explanatory view illustrating an attachment treatment of the first protective member 61 and the second protective member 62 to the vessel main body 20 using the assembly apparatus 400. FIG. 8 is a view provided for technical description and does not illustrate the actual dimension of the assembly apparatus 400 or the high-pressure tank 100. In addition, jigs holding the vessel main body 20 are not illustrated in FIG. 8 in order to facilitate technical understanding.

In step S20 in FIG. 7, the first protective member 61 is attached to a first jig 410 in the assembly apparatus 400. Specifically, the first protective member 61 is held by holding arms 412 of the first jig 410 (refer to arrows Ahv in FIG. 8). As a result, the first protective member 61 held by the first jig 410 is disposed on the opposite side of the panel 24 from the shell plate 22 so as to face the panel 24. Meanwhile, an adhesive is adhered to an inner surface (a surface to come into contact with the panel 24) of the first protective member 61.

Meanwhile, FIG. 8 illustrates a state in which the first protective member 61 and the second protective member 62 have been attached to the vessel main body 20. However, in the attachment of the first protective member 61 to the first jig 410 and the attachment of the second protective member 62 to a second jig 420, the vessel main body 20, the first protective member 61, and the second protective member 62 that are held in the assembly apparatus 400 are separated from one another in the X-axis direction.

In step S30 in FIG. 7, the second protective member 62 is attached to the second jig 420 in the assembly apparatus 400. Specifically, the second protective member 62 is held by holding arms 422 of the second jig 420 (refer to arrows Ahe in FIG. 8). As a result, the second protective member 62 held by the second jig 420 is disposed on the opposite side of the panel 26 from the shell plate 22 so as to face the panel 26.

Meanwhile, an adhesive is adhered to an inner surface (a surface to come into contact with the panel 26) of the second protective member 62.

In a state in which steps S30, S40 in FIG. 7 have ended, the vessel main body 20, the first protective member 61, and the second protective member 62 are held in the assembly apparatus 400 such that the respective central axes coincide with the rotation axis of the second jig 420 in the assembly apparatus 400.

In step S40 in FIG. 7, the first protective member 61 and the second protective member 62 are attached to the panels 24, 26 of the vessel main body 20 disposed between the first protective member 61 and the second protective member 62 by rotating the second jig 420 around the central axis O and pressing the second jig 420 toward the first jig 410 (refer to an arrow Af).

Figure 9:
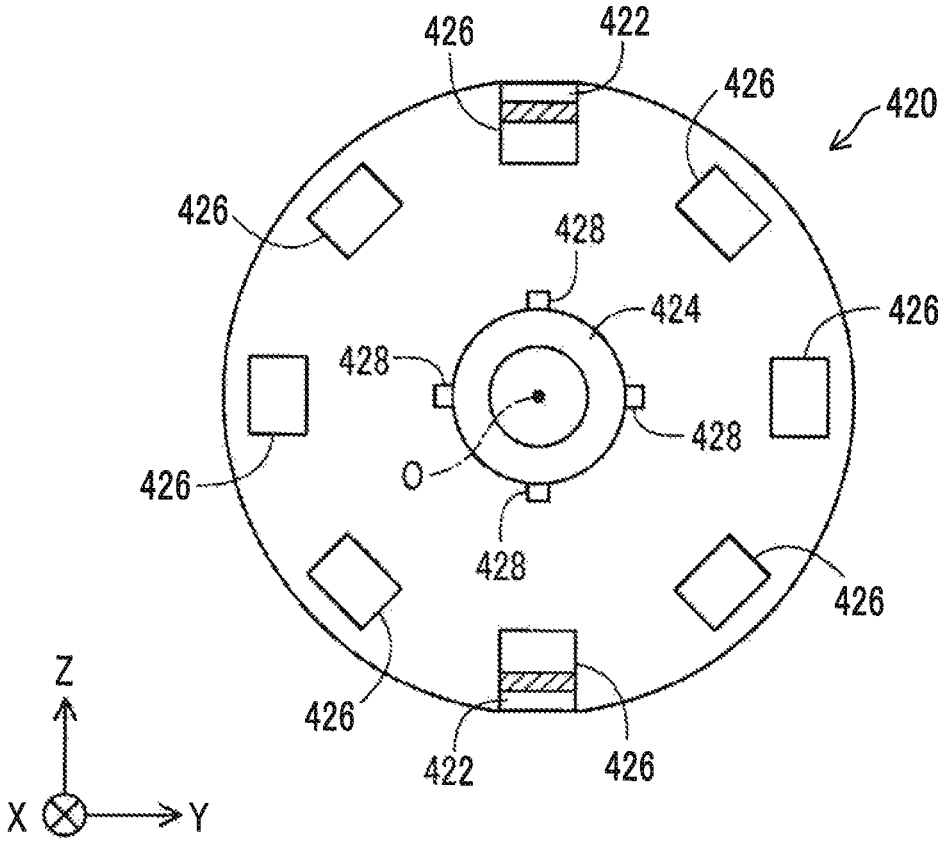
FIG. 9 is a cross-sectional view illustrating a second jig in an assembly apparatus.

FIG. 9 is a cross-sectional view illustrating the second jig 420 in the assembly apparatus 400. FIG. 9 illustrates a cross-sectional view of a IX-IX cross-section in FIG. 8. FIG. 9 is a view provided for technical description and does not illustrate the actual dimension of the second jig 420. The second jig 420 includes a holding shaft 424 and supporting portions 426. The holding shaft 424 is a structure having a substantially cylindrical form around a rotation axis O of the second jig 420. The outer diameter of the holding shaft 424 is set to be slightly smaller than the inner diameter of the opening (refer to 62*eo* in FIG. 3) at the end portion of the second protective member 62 on the positive side of the X-axis. On the outer circumference of the holding shaft 424, four protrusions 428 are provided at equal angular intervals of 90° around the central axis O. The protrusion 428 on the holding shaft 424 has a shape corresponding to that of the recess 62*n* of the second protective member 62.

The second jig 420 includes eight supporting portions 426 disposed at equal angular intervals of 45° around the rotation axis O of the second jig 420. Each of the supporting portions 426 has a substantially triangular-prism shape. The eight supporting portions 426 are disposed such that sloped surfaces of the triangular prisms face the rotation axis O of the second jig 420 (refer to FIG. 8). The holding arms 422 are provided on the outside of one pair of the supporting portions 426, the supporting portions 426 facing each other with the rotation axis O interposed therebetween. FIG. 9 illustrates a cross-sectional view of a pair of the holding arms 422.

In the attachment of the second protective member 62 to the second jig 420 (refer to S40 in FIG. 7), the holding shaft 424 is inserted into the opening (refer to 62*eo* in FIG. 3) at the end portion of the second protective member 62 on the positive side of the X-axis. The four protrusions 428 on the holding shaft 424 are respectively received by the four recesses 62*n* in the opening of the second protective member 62. The outer surface of the second protective member 62 comes into contact with the respective sloped surfaces of the eight supporting portions 426 (refer to FIG. 8). However, the four protrusions 428 on the holding shaft 424 do not reach the inner ends of the four recesses 62*n* in the opening of the second protective member 62 in the X-axis direction. That is, the protrusions 428 on the holding shaft 424 and the eight supporting portions 426 are configured so that the protrusions 428 do not pass through the recesses 62*n* of the second protective member 62 and reach the inner surface (the surface of the panel 26) of the second protective member 62.

As described above, the four protrusions 428 on the holding shaft 424 are respectively received by the four recesses 62*n* in the opening of the second protective member 62, and thus it is not possible to appropriately attach the first protective member 61 having the recesses 61*n* that are different from the recesses 62*n* of the second protective member 62 in shape, the number, and disposition to the second jig 420. In other words, the second jig 420 includes the protrusions 428 that cannot be contained in the recesses 61*n* of the first protective member 61. Therefore, in the manufacturing of the high-pressure tank 100, it is possible to prevent an incidence in which the first protective member 61 is erroneously attached to the second jig 420 instead of the second protective member 62 and is consequently attached to the panel 26.

In addition, in the embodiment, the four protrusions 428 on the holding shaft 424 are respectively received by the four recesses 62*n* in the opening of the second protective member 62, and thus it is possible to prevent the occurrence of sliding of rotation in the circumferential direction between the second jig 420 and the second protective member 62 when the second protective member 62 is attached to the panel 26 by rotating and pressing the second protective member to the panel 26.

Meanwhile, an aspect in which the first protective member 61 and the second protective member 62 are differentiated from each other by forming recesses at the end of the second protective member 62 on the shell plate 22 side (on the negative side of the X-axis) can also be considered. However, in the aspect, it is not possible to obtain the effect of preventing sliding in the combination of the jig with the protrusions. In addition, the effect of preventing sliding between the vessel main body 20 and the second protective member can also be obtained by providing protrusions in the end portion 24*e* of the panel 24 or the shell plate 22 and combining the protrusions with the recesses provided at the end of the second protective member 62 on the shell plate 22 side. However, in the high-pressure tank 100 containing high-pressure gas, it is not preferable to form protrusions and recesses in the vessel main body 20 (the panel 24 and the shell plate 22).

In the embodiment, the recesses 62*n* opened toward the central, axis O of the rotation are provided so as to reach the inner surface of the second protective member 62 in contact with the panel 26 (refer to the cross-sectional view of FIG. 3). Therefore, the contact surface of the second protective member 62 with the panel 26 has a contour shape having a component (component in the radial direction) perpendicular to the circumferential direction of rotation in the recesses 62*n* (refer to the plan view of FIG. 3). More specifically, the recesses 62*n* are disposed radially around the rotation axis O in a radial form. Therefore, when the second protective member 62 is rotated and pressed to the panel 26, the end portions of the recesses 62*n* generate friction forces in the circumferential direction, and thus sliding in the circumferential direction does not easily occur between the second protective member 62 and the panel 26.

The first jig 410 in the assembly apparatus 400 also has substantially the same configuration as the second jig 420. However, the first jig 410 is different from the second jig 420 in the number, disposition, and shape of protrusions 418 provided in a holding shaft 414. In addition, the first jig 410 is not configured to move in the X-axis direction (refer to the arrow Af in FIG. 8). The first jig 410 is the same as the second jig 420 in other aspects.

In the attachment of the first protective member 61 to the first jig 410, the holding shaft 414 is inserted into the opening (refer to 61*eo* in FIG. 2) in the end portion of the first protective member 61 on the negative side of the X-axis. Three protrusions on the holding shaft 414 are respectively received by the three recesses 61*n* in the opening of the first protective member 61. The outer surface of the first protective member 61 comes into contact with a sloped surface of each of eight supporting portions 416 (refer to FIG. 8). The three protrusions 418 on the holding shaft 414 and the eight supporting portions 416 are configured such that the protrusions 418 do not reach the surfaces of the recesses 61*n* in the opening of the first protective member 61 in the X-axis direction.

Therefore, the second protective member 62 having the recesses 62*n* that are different from the recesses 61*n* of the first protective member 61 in shape, the number, and disposition cannot be appropriately attached to the first jig 410. Therefore, in the manufacturing of the high-pressure tank 100, it is possible to prevent an incidence in which the second protective member 62 is erroneously attached to the first jig 410 instead of the first protective member 61 and is consequently attached to the panel 24. In addition, when the first protective member 61 is attached to the panel 24 by rotating the panel 24 together with the second protective member 62 and pressing the panel to the first protective member 61, it is also possible to prevent an incidence in which sliding occurs between the first jig 410 and the first protective member 61. Furthermore, sliding in the circumferential direction does not easily occur between the panel 24 and the first protective member 61.

Figure 10:
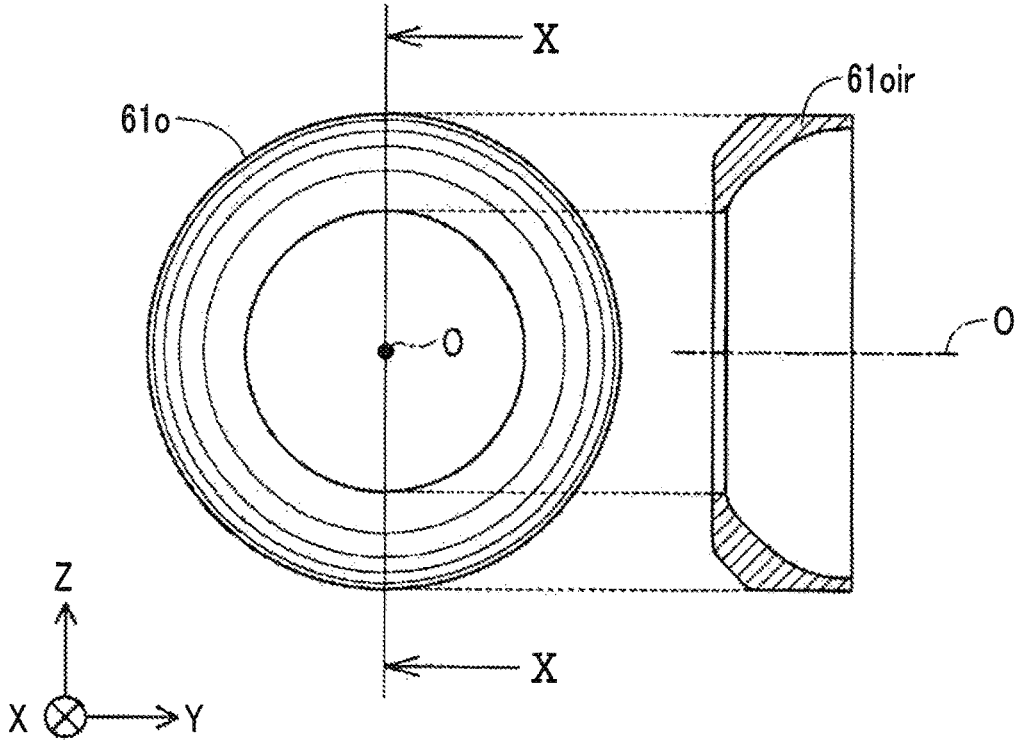
FIG. 10 is an explanatory view illustrating a first protective member of a reference example.

FIG. 10 is an explanatory view illustrating a first protective member 61*o* of a reference example. FIG. 10 includes a plan view of the first protective member 61*o* and a cross-sectional view of an X-X cross-section illustrated in the plan view. The first protective member 610 of the reference example does not include any recesses 61*n*. That is, the first protective member 61*o* has a configuration that is uniform in the circumferential direction around the central axis O. The first protective member 61*o* is the same as the first protective member 61 of the embodiment in other aspects. For example, the first protective member 61*o* is configured of a single foamable polyurethane layer 61*oir*.

Figure 11:
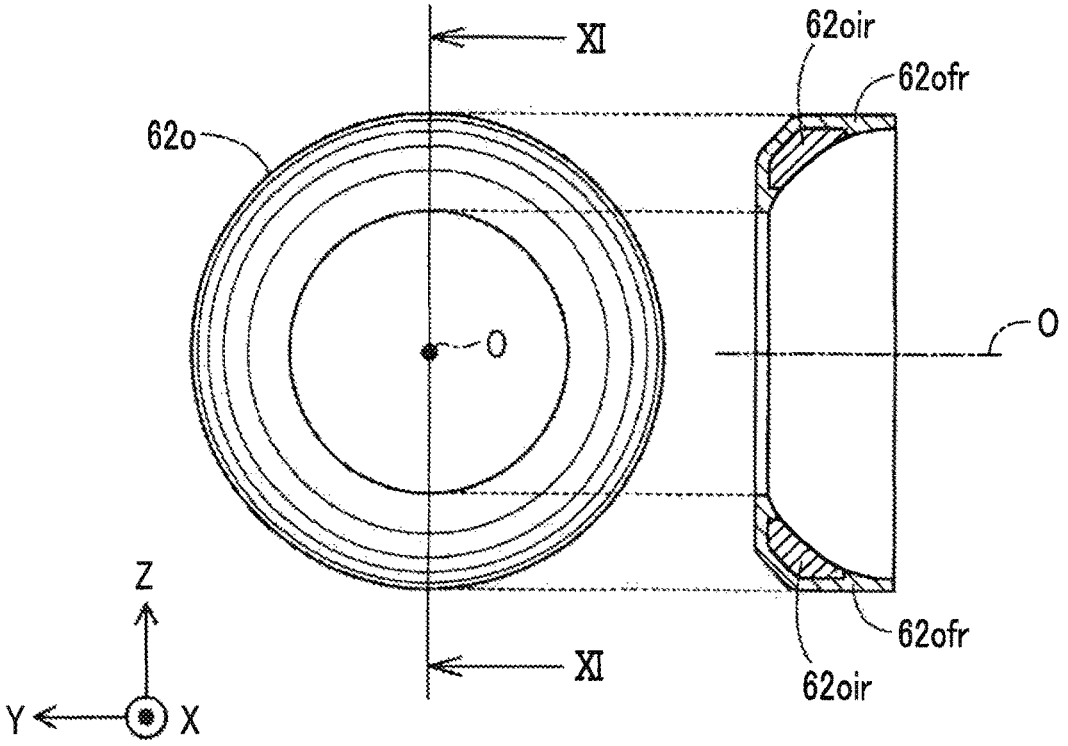
FIG. 11 is an explanatory view illustrating a second protective member of a reference example.

FIG. 11 is an explanatory view illustrating a second protective member 62*o* of the reference example. FIG. 11 includes a plan view of the second protective member 62*o* and a cross-sectional view of a XI-XI cross-section illustrated in the plan view. The second protective member 62*o* of the reference example does not include any recesses 62*n*. That is, the second protective member 62*o* has a configuration that is uniform in the circumferential direction around the central axis O. The second protective member 62*o* is the same as the second protective member 62 of the embodiment in other aspects. For example, the second protective member 62*o* is configured of a first layer 62*oir* positioned inside and a second layer 62*ofr* that is positioned outside and exhibits a heat-shielding function.

The first protective member 61*o* and the second protective member 62*o* are different in internal structure, but are the same in outer form shape. In assembly apparatuses used to attach the first protective member 61*o* and the second protective member 62*o* of the aspect, protrusions are not provided in holding shafts of jigs that hold the respective protective members. As a result, when respectively attached to the jigs, the first protective member 61*o* and the second protective member 62*o* may be attached to incorrect jigs. As a result, the second protective member 62*o* including the second layer 62*ofr* having a heat-shielding function may be disposed to the panel 24 provided with the valve 50. In addition, the first protective member 61*o* having no heat-shielding function may be disposed to the panel 26.

In addition, there is a high possibility of the occurrence of sliding between the first protective member 61*o* and the second protective member 62*o* and the jigs that hold the respective protective members. Furthermore, there is also a high possibility of the occurrence of sliding in the circumferential direction between the first protective member 61*o* and the panel 24, and between the second protective member 62*o* and the panel 26.

Step S10 in the embodiment corresponds to step (a) in "SUMMARY". Step S20 corresponds to step (b). Step S30 corresponds to step (c). Step S40 corresponds to step (d).

MODIFICATION EXAMPLES

Modification Example 1

In the embodiment, the fusible plug valve is provided in the valve 50 attached to the panel 24. However, the fusible plug valve can also be directly attached to the panel.

In addition, in the embodiment, the fusible plug valve is provided in the high-pressure tank 100. However, the high-pressure vessel may not have any fusible plug valves. However, the high-pressure vessel is preferably provided with a predetermined configuration which makes performances needed for the protective members disposed in the two panels different. For example, a configuration for discharging heat in the high-pressure vessel to the outside may be provided to the high-pressure vessel. In the aspect, one protective member close to a heat-discharging portion needs to have better heat-shielding performance or anti-flame performance than the other protective member far from the heat-discharging portion in order to prevent an incidence in which external heat transfers to the inside of the high-pressure vessel.

In the embodiment, the high-pressure tank 100, as the pressure vessel, contains hydrogen gas. However, the pressure vessel may have an aspect of containing gases other than hydrogen. However, the pressure vessel is preferably a vessel that contains gases at a higher pressure than the external pressure.

Modification Example 2

In the embodiment, the recesses 61*n* are provided from the outer surface through the inner surface (the surface in contact with the panel 24) of the first protective member 61. In addition, the recesses 62*n* are also provided from the outer surface through the inner surface (the surface in contact with the panel 26) of the second protective member 62. However, the recesses provided in the protective members may also have a shape not opening toward the surface in contact with the panel. However, the recesses provided in the protective members preferably have shapes enabling the differentiation of the first protective member and the second protective member from the outer form.

Modification Example 3

In the embodiment, the first protective member 61 is configured of the single layer 61*ir* of foamable polyurethane. In addition, the second protective member 62 includes the first layer 62*ir* made of foamable polyurethane and the second layer 62*fr* made of foamable polyurethane including expandable graphite. However, as the materials configuring the first protective member and the second protective member, it is possible to use other materials. However, the first protective member and the second protective member are preferably materials configured to exhibit different performances while having substantially the same outer form shape.

For example, in the aspect in which the fusible plug valve is provided in one panel, it is preferable that the first protective member and the second protective member have substantially the same outer form shape and the second protective member can be provided with better heat-shielding performance than the first protective member. As materials that realize the difference in performance as described above, for example, materials having a higher porosity than the material of the first protective member can be applied as the material of the second protective member.

Modification Example 4

In the embodiment, the second protective member 62 has better heat-shielding performance than the first protective member 61. However, the first protective member 61 and the second protective member 62 may exhibit different performances in other aspects while having substantially the same outer form shape. For example, the second protective member may have better impact-resisting performance than the first protective member. In addition, the second protective member can also be provided with a configuration in which performance of suppressing breakage caused by the internal pressure of the high-pressure tank is better than that of the first protective member. The first protective member and the second protective member are preferably capable of exhibiting different performances while having substantially the same outer form shape.

Modification Example 5

In the embodiment, the second protective member 62 has the recesses that the first protective member 61 does not have in terms of shape, the number, and disposition. In addition, the first protective member 61 has the recesses that the second protective member 62 does not have in terms of shape and disposition.

The aspect in which "one protective member does not have" the recesses that the other protective member has includes an aspect in which recesses are not provided in one protective member while recesses are provided in the other protective member. In addition, the aspect in which "one protective member does not have" the recesses that the other protective member has includes an aspect in which two or more recesses are provided in the other protective member, but a smaller number of recesses are provided in one protective member than in the other protective member. Furthermore, the aspect in which "one protective member does not have" the recesses that the other protective member has includes an aspect in which both protective members are provided with two or more recesses, but the dispositions of the recesses with respect to one recess are different in the respective protective members. In addition, the aspect in which "one protective member does not have" the recesses that the other protective member has includes an aspect in which both protective members are provided with the same number (two or more) of recesses in the same disposition, but the recesses provided in the respective protective members have different shapes from each other.

That is, the recesses in the first protective member and the recesses in the second protective member may be different from each other in at least one of the number, disposition, and shape.

Modification Example 6

In the embodiment, the protrusions 428 are provided in the second jig 420. In addition, the protrusions 418 are provided in the first jig 410. However, it is also possible to employ an aspect in which the protrusions that are received by the recesses in the protective members are not provided in at least one of the first jig and the second jig.

Modification Example 7

When the first protective members and the second protective member are different from each other in at least one of the number, disposition, and shape of the recesses, the number, disposition, and shape of the protrusions of the first jig and the second jig may be the same as each other. In addition, the first jig and the second jig may not have the protrusions. However, it is preferable that at least one of the first jig and the second jig is provided with the protrusions and the protrusions are provided in shape, the number, and disposition enabling the protrusions to be received by the recesses of the protective member to which the protrusions are supposed to be attached. Furthermore, it is preferable that at least one of the first jig and the second jig is provided with the protrusions and the protrusions of the first jig and the second jig are provided in shape, the number, and disposition disabling the protrusions to be received by the recesses of the protective member to which the protrusions are not supposed to be attached.

Modification Example 8

In the embodiment, in step S20 in FIG. 7, the first protective member 61 is attached to the first jig 410 of the assembly apparatus 400 and is disposed at a position at which the first protective member faces the panel 24. After that, in step S30, the second protective member 62 is attached to the second jig 420 of the assembly apparatus 400 and is disposed at a position at which the second protective member faces the panel 26. However, the second protective member may be disposed to the panel before the first protective member is disposed to the panel. In addition, the first protective member and the second protective member may be respectively disposed to the panels at the same time.

Modification Example 9

In the embodiment, although not particularly described, the fusible plug valve may already be attached to the panel in the stage of attaching the first protective member and the second protective member to the panels or may be attached after the attachment of the first protective member to the panel.

Modification Example 10

In the embodiment, the first protective member 61 and the second protective member 62 are attached to the panels 24, 26 of the vessel main body 20 by rotating the second jig 420 and pressing the second jig 420 toward the first jig 410 (refer to the arrow Af in FIG. 8). However, instead of the second protective member, the first protective member may be rotated and pressed. In addition, both the first protective member and the second protective member may be rotated and pressed. Furthermore, one protective member may be rotated while the other protective member may be pressed.

The present disclosure is not limited to the embodiment, the example, and the modification examples and can be realized in a variety of configurations within the scope of the gist of the present disclosure. For example, the technical features in the embodiment, the example, and the modification examples which correspond to the technical features in the respective forms described in "SUMMARY" can be appropriately replaced or combined in order to achieve a part or all of the effects. In addition, the technical features can be appropriately deleted unless described as indispensable in the specification.

What is claimed is:

1. A pressure vessel comprising:

a vessel main body including a cylindrical shell plate, a first domical panel, and a second domical panel, the first domical panel being disposed at first end of the cylindrical shell plate, the second domical panel being disposed at second end of the cylindrical shell plate, the vessel main body being configured to contain gas inside the vessel main body;

a first protective member disposed so as to surround a peak of the first domical panel, the first protective member including an end portion having an inner surface defining an opening; and a second protective member disposed so as to surround a peak of the second domical panel, the second protective member including a material different from a material of the first protective member and being configured to exhibit performance that is different from that of the first protective member, wherein the first protective member has one or more first recesses at an end on the peak side of the first domical panel, the one or more first recesses being defined in the inner surface of the end portion of the first protective member, the second protective member has one or more second recesses at an end on the peak side of the second domical panel or no recesses, the one or more second recesses extending from an inner periphery edge of the second protective member, and at least one of a shape, a number, and a disposition of the one or more first recesses is different from at least one of a shape, a number, and a disposition of the one or more second recesses.

2. The pressure vessel according to claim 1, wherein:

the vessel main body includes a fusible plug valve in the first domical panel;

the first protective member is disposed so as to surround the peak of the first domical panel and the fusible plug valve; and the second protective member has better heat-shielding performance than the first protective member.

3. The pressure vessel according to claim 1, wherein:

the one or more first recesses of the first protective member and the one or more second recesses of the second protective member have different shapes from each other.

4. The pressure vessel according to claim 1, wherein the material of the second protective member has a higher porosity than the material of the first protective member.

5. The pressure vessel according to claim 1, wherein the number of the one or more first recesses is different from the number of the one or more second recesses.

6. The pressure vessel according to claim 1, wherein at least one of the one or more first recesses or the one or more second recesses has a shape not opening toward the vessel main body.

7. The pressure vessel according to claim 1, wherein at least one of the one or more first recesses or the one or more second recesses has a shape opening toward the vessel main body.

* * * * *